US007827649B2

(12) United States Patent
Horian

(10) Patent No.: US 7,827,649 B2
(45) Date of Patent: Nov. 9, 2010

(54) CLEANING APPARATUS WITH AN AUTOMATICALLY RETRACTABLE HEAD

(76) Inventor: James G. Horian, 14 Sidra Cove 4U, Newport Beach, CA (US) 92657

( * ) Notice: Subject to any disclaimer, the term of this patent is extended or adjusted under 35 U.S.C. 154(b) by 748 days.

(21) Appl. No.: 11/825,163

(22) Filed: Jul. 5, 2007

(65) Prior Publication Data

US 2009/0007351 A1 Jan. 8, 2009

(51) Int. Cl.
*B25G 3/38* (2006.01)

(52) U.S. Cl. ..... 15/144.2; 15/144.1; 16/900; 403/120; 403/145; 403/150

(58) Field of Classification Search ..... 15/144.1, 15/144.2; 16/438, 900; 403/120, 145, 150
See application file for complete search history.

(56) References Cited

U.S. PATENT DOCUMENTS

| | | | | | |
|---|---|---|---|---|---|
| 960,655 | A * | 6/1910 | Mabey | 403/120 |
| 1,100,029 | A * | 6/1914 | Severns | 15/144.1 |
| 1,222,971 | A * | 4/1917 | Moe | 403/120 |
| 1,497,079 | A * | 6/1924 | Gullborg et al. | 15/244.2 |
| 1,797,366 | A * | 3/1931 | Rackliffe | 403/86 |
| 2,668,312 | A * | 2/1954 | Solomon | 15/229.6 |
| 2,796,617 | A * | 6/1957 | Bradshaw | 15/1 |
| 3,103,028 | A * | 9/1963 | Richards | 15/118 |
| 3,473,183 | A * | 10/1969 | Ercoli et al. | 15/144.1 |
| 3,506,996 | A * | 4/1970 | Brennan | 15/144.1 |
| 3,599,265 | A * | 8/1971 | D'Ercoli et al. | 15/70 |
| 4,809,387 | A | 3/1989 | Nakamura et al. | |
| 5,657,507 | A * | 8/1997 | Wasak | 15/220.1 |
| 5,943,727 | A | 8/1999 | Freer | |
| 5,979,004 | A | 11/1999 | Wilson | |
| 6,543,081 | B1 | 4/2003 | Cohen | |
| 2004/0226125 | A1 * | 11/2004 | Cox | 15/245 |

* cited by examiner

*Primary Examiner*—Mark Spisich
(74) *Attorney, Agent, or Firm*—Stetina Brunda; Garred S Brucker

(57) ABSTRACT

A cleaning apparatus includes an elongate rod defined by a proximal end portion having a first linkage member and an opposed distal end portion. The first linkage member is pivotally coupled to a second linkage member of a cleaning head. There is a biasing assembly that is coupled to the elongate rod and to the cleaning head, which tensions the cleaning head to a maximum pivotal excursion relative to the cleaning rod.

3 Claims, 4 Drawing Sheets

CLEANING APPARATUS WITH AN AUTOMATICALLY RETRACTABLE HEAD

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present invention relates generally to cleaning devices. More particularly, the present invention relates to cleaning devices with retractable heads for storage ease.

2. Related Art

There are varieties of cleaning devices known in the art, each being suited for a particular purpose or application. As floors are typically the most often cleaned surface due to its tendency to accumulate dust and other debris, cleaning devices adapted therefor are numerous and varied. Generally, the maintenance worker cleans floors from a standing position. The operative surface of the cleaning device is swept across the surface of the floor as the maintenance worker traverses the same. Accordingly, most cleaning devices adapted for floor cleaning functions have a head or other operative cleaning component that is disposed toward the ground and a rod or like component that can be manipulated by the maintenance worker from a standing position.

Typical floor cleaning devices generally comport with the aforementioned structure; different operative cleaning components are substituted for particular uses, and the elongate portion connected to the operative cleaning component may serve one or more purposes. A vacuum cleaner, for example, is suited for removing dust and other like small particles from carpeted floor surfaces. The vacuum head is the inlet by which the debris is removed from the floor, and the collected debris is conveyed to a chamber that forms the elongate portion of the device. Mops are used to wash or scrub the floor surface, to clean up liquid spills, and to apply wax or other similar surface treatments, and are likewise comprised of an elongate rod and an operative cleaning component that is formed of water-absorbent fabric strands, referred to as a mop head. The mop head is typically dipped in a cleaning solution that is released when the mop head contacts the floor surface. Simultaneously, excess moisture on the floor such as spills and the like may be absorbed into the mop head.

In addition to the "wet" mops previously described, also known in the art are dry mops, which typically feature flat, elongate mop heads that are adapted to collect dust and other small debris on smooth floor surfaces. The mop head is pivotally attached to the elongate portion or rod, and is pushed across the floor surface in long, sweeping motions without being lifted therefrom. Such flat, elongate mop heads may also be fitted with alternative fabrics that feature scrubbing surfaces or liquid-absorbent characteristics. Depending on the size of the mop head, scrubbing techniques more commonly associated with conventional wet mops may be used.

Mops and other cleaning devices are typically stored out of the way when not in use. The space required for storing such implements may range from a relative small space to a large space, depending on the size of the head. In residences, mops are typically stored in a garage or closet, or concealed adjacent to an article of furniture or an appliance. In commercial establishments with dedicated maintenance workers, cleaning devices are generally stored in a designated location. In either case, the space dedicated for storage of cleaning devices is limited, and storing in open locations is undesirable because of actual and perceived sanitary issues. Thus, creative storage techniques are necessary to maximize use of such limited space.

One of the more common ways of storing mops and brooms is placing the head on the ground and leaning the rod against a vertical surface such as a door or wall. This is undesirable because of the additional floor space that the mop head occupies, particularly when that space is better utilized in storing additional cleaning devices. Because of the freely-pivoting relationship between the rod and the mop head, the rod may unpredictably become lodged against a door jamb or other structure after placement. The cleaning device may also be suspended, but again, the mop head occupies additional lateral space. The mop head may be manually positioned such that it is parallel to the rod, but this is undesirable because of the dirtiness of the mop head.

Accordingly, there is a need in the art for an improved cleaning apparatus. Specifically, there is a need for a cleaning apparatus with an automatically retractable head that may be easily stored in a manner that minimizes space utilization. Furthermore, there is a need for a cleaning apparatus that may be configured for storage without manual manipulation of the storage head.

BRIEF SUMMARY

In accordance with one embodiment of the present invention, there is provided a cleaning apparatus. The cleaning apparatus may include an elongate rod that defines a proximal end portion, and an opposed distal end portion. The elongate rod may include a first linkage member that is disposed on the proximal end portion. Additionally, the cleaning apparatus may include a cleaning head that has a second linkage member that is pivotally coupled to the first linkage member of the elongate rod. The cleaning head may define a cleaning side and an opposite rod attachment side. There is also included a biasing assembly that is coupled to the elongate rod and to and to the cleaning head. The biasing assembly is understood to tension the cleaning head to a maximum pivotal excursion thereof relative to the elongate rod, allowing for the cleaning head to retract automatically when suspended or otherwise lifted from the floor. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of the presently preferred embodiment of the invention, and is not intended to represent the only form in which the present invention may be constructed or utilized. It is understood that the use of relational terms such as first and second, top and bottom, and the like are used solely to distinguish one from another entity without necessarily requiring or implying any actual such relationship or order between such entities.

Figure 1:
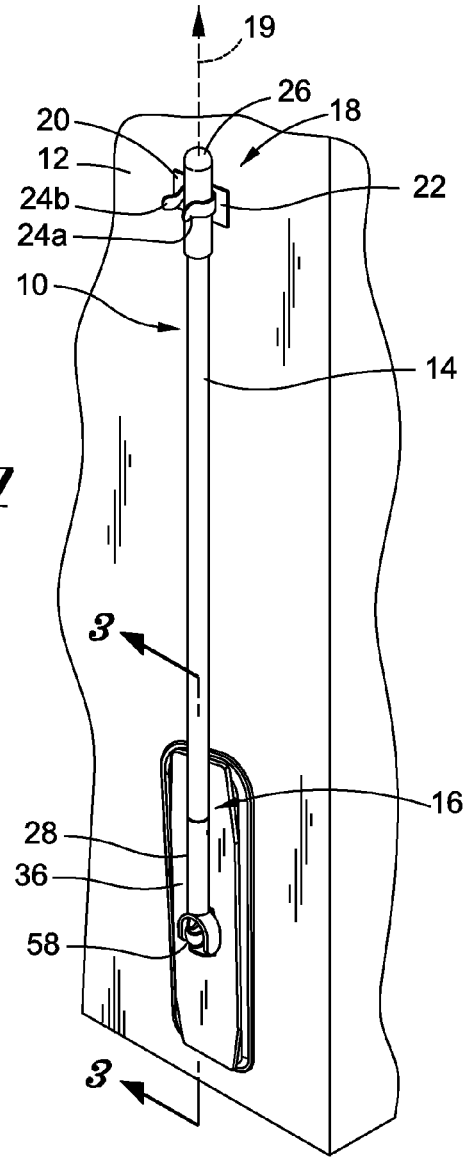
FIG. 1 is a perspective view of a cleaning device in accordance with a first embodiment mounted against a wall in a first configuration.

With reference to FIG. 1, a cleaning apparatus 10 is shown mounted against a vertical surface 12. The cleaning apparatus 10 includes an elongate rod 14 that defines a proximal end portion 16, an opposed distal end portion 18, and a central axis 19. In the particular embodiment illustrated, the cleaning apparatus 10 is mounted to the vertical surface 12 with a clamp mount 20. The clamp mount 20 is generally comprised of a flat plate 22 that is glued, nailed, screwed or otherwise attached to the vertical surface 12, and a pair of opposed clamp arms 24*a*, 24*b* extending from the flat plate 22 in a perpendicular relation thereto. With further particularity, the distal end portion 18 includes a grip 26 that may be constructed of rubber or other like flexible material with a high coefficient of friction. Thus, the frictional engagement of the clamp arms 24*a*, 24*b* to the grip 26 and the elongate rod 14 is maintained. Along these lines, the clamp arms 24*a*, 24*b* are shaped to wrap around the cylindrical shape of the grip 26 and the elongate rod 14 and thereby maximize the contact surface area therebetween. It will be appreciated by those having ordinary skill in the art that this particular mounting configuration is presented by way of example only and not of limitation, and any other alternative mounting modality may be readily substituted without departing from the scope of the present invention.

Figure 3:
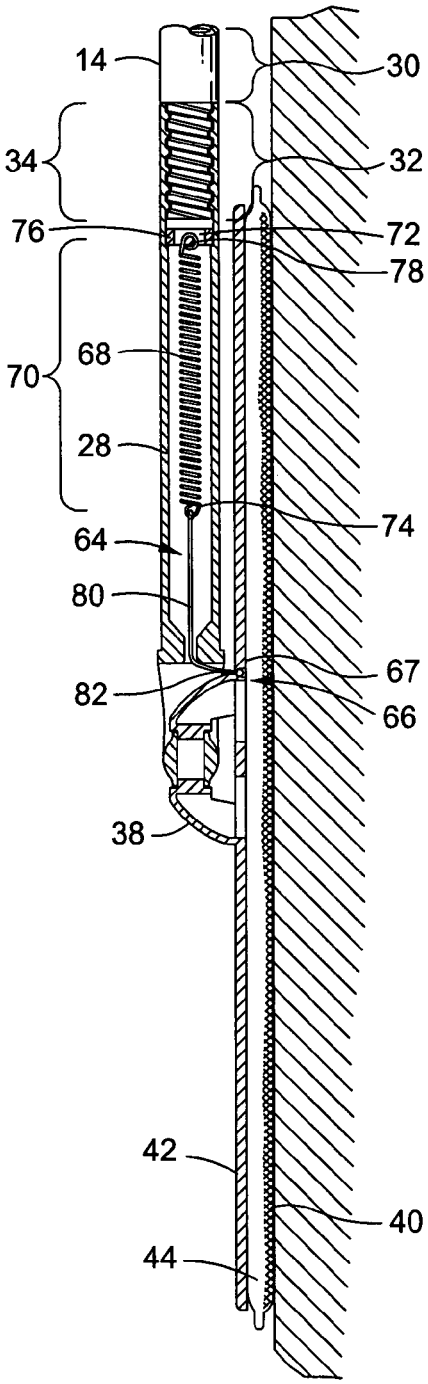
FIG. 3 is a cross sectional view of the cleaning head and the first linkage member taken along axis 3-3 of FIG. 1.

The proximal end portion 16 includes a first linkage member 28 that may be separately attached to the elongate rod 14 as shown in FIGS. 1 and 3. It is contemplated that the elongate rod 14 is cylindrical, with a smooth portion 30 and a threaded plug portion 32. The first linkage member 28 is likewise cylindrical and includes a corresponding interior threaded portion 34 that is engageable to the threaded plug portion 32 of the elongate rod 14. In other words, the elongate rod 14 may be rotated on to the first linkage member 28. As will be appreciated, modularization of the components of the cleaning apparatus 10 is achieved, and each component may be readily replaced without replacing the entirety of the cleaning apparatus 10. Other linking mechanisms are also envisioned, including loaded spring stopper mechanisms, snapping mechanisms, and the like. Alternatively, however, the first linkage member 28 may be integrally formed and be of a unitary construction with the first linkage member 28.

Figure 2:
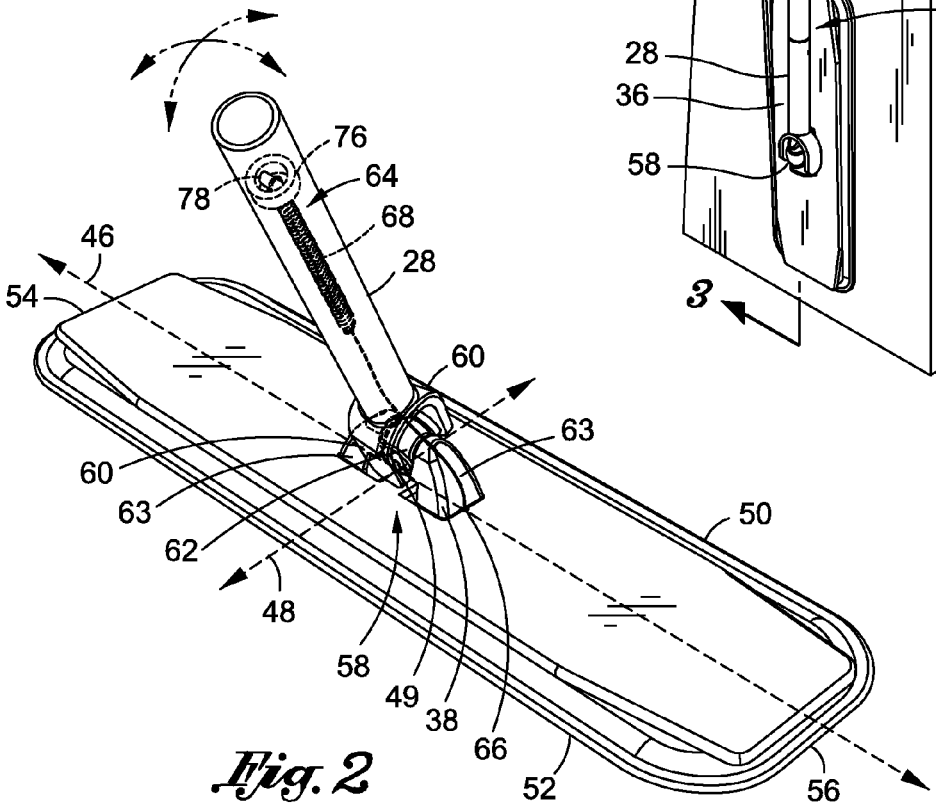
FIG. 2 is a perspective view of a cleaning head pivotally mounted to a first linkage member of the cleaning device, with the interior of the first linkage member including a biasing assembly.

Referring to FIG. 1, the cleaning apparatus 10 further includes a cleaning head 36 pivotally mounted to the elongate rod 14. More particularly, the cleaning head 36 includes a second linkage member 38 that is pivotally coupled to the first linkage member 28. The cleaning head 36 generally defines a cleaning side 40 and a rod attachment side 42. Generally, the cleaning side 40 is a dust-attractive fabric 44, though it may be any other type of cleaning material as described above in the background. The cleaning side 40 contacts the floor that is being swept or cleaned. One embodiment of the cleaning head 36 as shown in FIG. 2 is rectangular and defines a central lateral axis 46, as well as a central longitudinal axis 48 that is perpendicular thereto. Furthermore, the cleaning head 36 defines a forward edge 50, a back edge 52, a left side edge 54, and a right side edge 56. A cleaning head center region 58 is generally defined by an intersect point 49 of the central lateral axis 46 and the central longitudinal axis 48, and the elongate rod 14 is fixed thereto. It is understood that the general shape and configuration of the cleaning head 36 may be varied; however, such alternative configurations generally define the central lateral axis 46 and the central longitudinal axis 48.

According to one embodiment, the first linkage member 28 is coupled to the second linkage member 38 in a universal joint. Specifically, the first linkage member 28 includes a pair of opposed first hinge arms 60 rotatably mounted to a gimbal 62. The second linkage member 38 similarly includes a pair of opposed second hinge arms 63, but are rotatably mounted to the gimbal 62 in an orientation perpendicular to that of the first linkage member 28. As will be appreciated, this allows the first linkage member 28, and thus the elongate rod 14, to rotate about the intersect point 49 along the central lateral axis 46 and along the central longitudinal axis 48. It will be recognized by those having ordinary skill in the art that any other pivoting modalities may be readily substituted for the above universal joint, including ball and socket joints and the like.

The cleaning apparatus 10 includes a biasing assembly 64 coupled to the elongate rod 14 and to the cleaning head 36. It is contemplated that the biasing assembly 64 tensions the cleaning head 36 to a maximum pivotal excursion thereof relative to the elongate rod 14. Without an opposing force being applied by the maintenance worker, the cleaning head 36 automatically swings into a storage position that minimizes the profile of the cleaning apparatus 10 as will be described in further detail below. For the particular exemplary embodiment where a universal joint couples the first linkage member 28 to the second linkage member 38, the maximum pivotal excursion is where the plane of the cleaning head 36 is parallel to the central axis 19 of the elongate rod 14. As shown in FIG. 1, storage of the cleaning apparatus 10 is achieved with substantial space savings.

Figure 4:
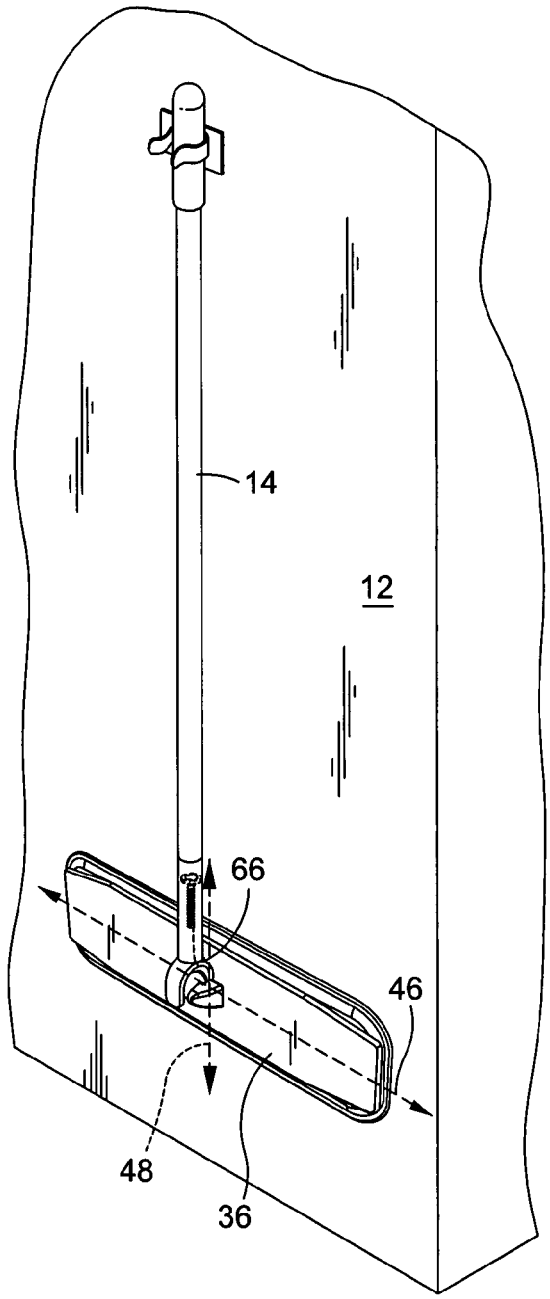
FIG. 4 is a perspective view of the cleaning device mounted against the wall in a second configuration.

The biasing assembly 64 is coupled to the cleaning head 36 at an attachment point 66 that is offset from the intersection point 49, thus pulling and automatically rotating the cleaning head 36 in a single direction. Where the attachment point 66 lies on the central lateral axis 46 and offset from the central longitudinal axis 48 as shown in FIGS. 1 and 2, the cleaning head 36 pivots about the central longitudinal axis 48, or along the central lateral axis 46. As best shown in FIG. 1, the cleaning head 36 is in a vertical orientation. Referring to FIGS. 3 and 4, where the attachment point 66 lies on the central longitudinal axis 48 and is offset from the central lateral axis 46, the cleaning head 36 pivots about the central lateral axis 46. FIG. 4 particularly illustrates the cleaning head 36 in a horizontal orientation.

In a first embodiment, the biasing assembly 64 includes a helical tension spring 68 disposed within the interior of the first linkage member 28. More particularly, the helical tension spring 68 defines a body portion 70, a first coil end 72 attached to the first linkage member 28, and an opposed, second coil end 74 coupled to the cleaning head 36. The first linkage member 28 includes an annular stopper 76 having a transverse finger 78, to which the first coil end 72 is hooked. It is contemplated that the annular stopper 76 is frictionally retained within the interior of the first linkage member 28.

As indicated above, the second coil end 74 is coupled to the cleaning head 36. In particular, the second coil end 74 is attached to a linking line 80, which in turn is attached to the cleaning head 36. It is contemplated that the linking line 80 is a thin, inflexible strand such as metal wire or nylon, polyethylene, or other synthetic fiber. By way of example only and not of limitation, the linking line 80 includes a ball-shaped plug element that is engaged to an attachment hole 67 defined by the cleaning head 36. It will be understood by those of ordinary skill in the art that the helical tension spring 68 imparts a compressive force upon the linking line 80, which in turn imparts a rotational force on the cleaning head 36. As explained above, the cleaning head 36 is tensioned or pulled to its maximum pivotal excursion.

Figure 5:
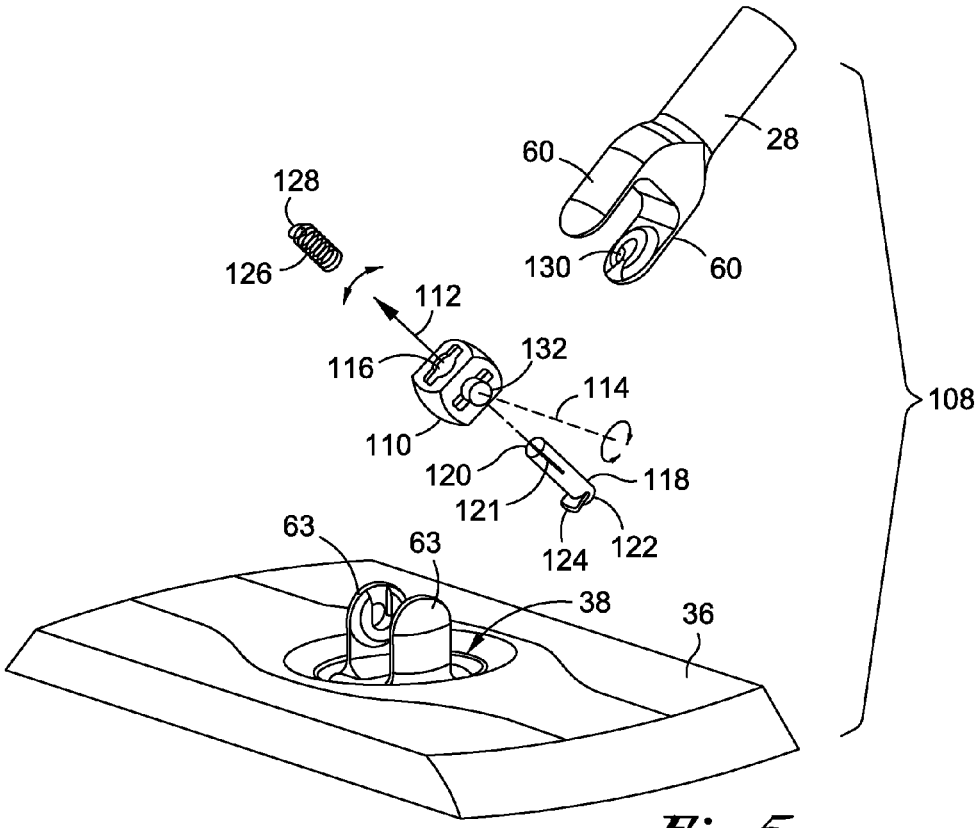
FIG. 5 is an exploded perspective view of a second embodiment of the cleaning device with an alternative biasing assembly incorporated into the pivotable coupling the first linkage member and the second linkage member.

FIG. 5 shows additional details of the pivoting modality described above, and also shows an alternative, second biasing assembly 108 that may be utilized in lieu of a first embodiment of the biasing assembly 36. It is contemplated that the second biasing assembly 108 is incorporated into the pivotable coupling of the first linkage member and the second linkage member 38, as will be described in further detail below.

As indicated above, the first linkage member 28 includes the first hinge arms 60, and the second linkage member 38 of the cleaning head 36 includes the second hinge arms 63. A gimbal 110 defines a first rotation axis 112 and a second rotation axis 114 that is perpendicular to the first rotation axis 112. The first linkage member 28 is mounted to the gimbal 110 about the first rotation axis 112, and the second linkage member 38 is mounted to the gimbal 110 about the second rotation axis 114. In the second embodiment of the biasing assembly 108, the gimbal 110 defines a bore 116 that extends therethrough, and is coaxial with the first rotation axis 112. Mated to the bore 116 is a pin 118 defining a first end 120 that defines a slot 121, and a second end 122 that includes a cam 124. A helical torsion spring 126 is inserted into the bore 116 in overlapping engagement with the pin 118. The helical torsion spring 126 includes a pin catch 128 which engages the slot 121. It is contemplated that the portion of the pin 118 that abuts from the bore 116 is rotatably coupled to the first linkage member 28, and the cam 124 connects to an inner wall 130 of the hinge arms 60. In this regard, rotation of the pin 118 causes a corresponding rotation of the first linkage member 28 about the first rotation axis 112. The gimbal 110 additionally includes a pair of opposed hinge rods 132 that extend therefrom and are coaxial with the second rotation axis 114. According to the embodiment shown in FIG. 5, the hinge rods 132 are integrally formed and are of a unitary construction with the gimbal 110. The hinge rods 132 are rotatably coupled to the second linkage member 38.

Figure 6:
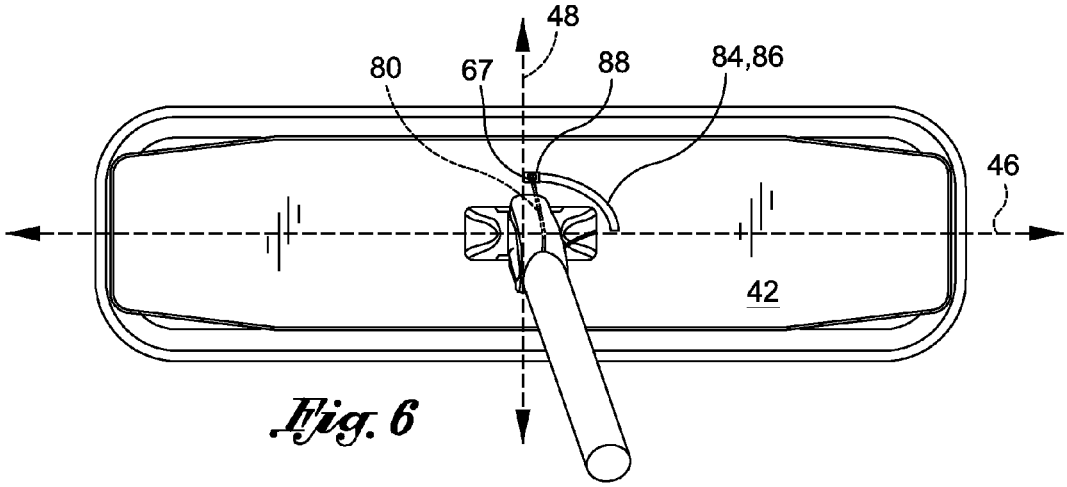
FIG. 6 is a top plan view of the cleaning head including an arcuate groove with a connection member in sliding engagement therewith.

With reference to FIG. 6, in another embodiment, the attachment point 66 of the biasing assembly 64 is selectable along any point on an arc 84 extending between the central lateral axis 46 and the central longitudinal axis 48. As indicated above, where the attachment point 66 is offset from the central longitudinal axis 48, the cleaning head 36 is pivoted to a vertical position shown in FIG. 1, and where the attachment point 66 is offset from the central lateral axis 46, the cleaning head 36 is pivoted to a horizontal position shown in FIG. 3. The adjustable attachment point 66 is understood the provide additional maximum excursion positions to accommodate other devices stored in the vicinity of the cleaning apparatus 10 and anomalies in the shape of the vertical surface 12.

According to one embodiment, the rod attachment side 42 of the cleaning head 36 defines a groove 86 that corresponds to the arc 84. Engaged to the groove 86 is a connection member 88 that defines the attachment point 66. In this regard, the connection member 88 includes the attachment hole 67, to which the linking line 80 is engaged. The connection member 88 is in a lockable, sliding engagement with the groove 86 that may have predetermined or indeterminate stops. It is contemplated that the connection member 88 slides within the groove 86 to set the angular relationship between the cleaning head 36 and the elongate rod 14 when it is at maximum pivotal engagement.

Figure 7:
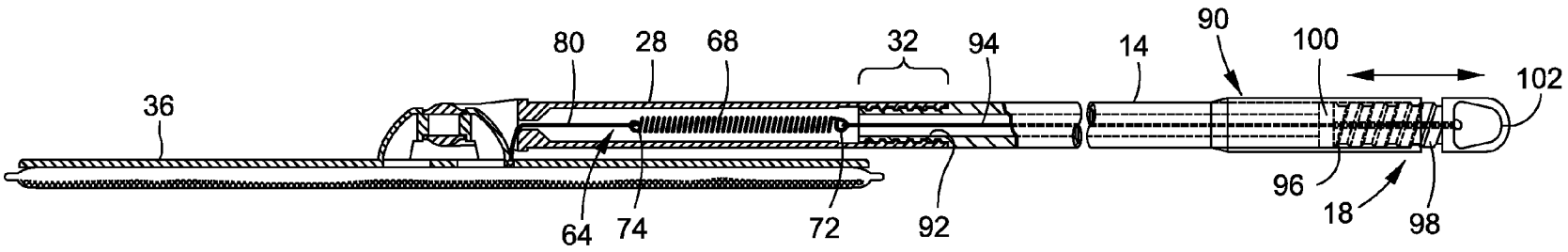
FIG. 7 is a cross sectional view of the cleaning device where the biasing assembly includes a bias adjuster in accordance with one embodiment.

Referring to FIG. 7, the tension applied by the biasing assembly 64 is adjustable. As indicated above, the biasing assembly 64 includes the helical tension spring 68 with a second coil end 74 coupled to the cleaning head 36 via the linking line 80. The first coil end 72, however, is coupled to a bias adjuster 90 that is attached to the elongate rod 14. The elongate rod 14 also includes the threaded plug portion 32, and additionally defines a hollow cylindrical interior 92 through which a second linking line 94 extends. The second linking line 94 is a thin, inflexible strand such as metal wire, nylon, polyethylene, or other synthetic fiber.

The distal end portion 18 of the elongate rod 14 has a hollow interior with helical threading grooves 96. The bias adjuster includes a hollow cylindrical member 98 having a first open end 100 and a second closed end 102. The hollow cylindrical member 98 also has a threaded exterior that is engageable to the helical threading grooves 96 of the elongate rod 14. The second linking line 94 passes through the first open end 100 and fixed to an attachment point in the vicinity of the second closed end 102. Rotation of the hollow cylindrical member 98 in a first or clockwise direction threads the same into the elongate rod 14, thereby decreasing the tension upon the helical tension spring 68. Accordingly, the rotational force imparted to the cleaning head 36 may be reduced, or eliminated entirely. Rotation of the hollow cylindrical member 98 in a second or counterclockwise direction pulls the same out of the elongate rod 14, thus increasing the tension upon the helical tension spring 68. It is contemplated that the maintenance worker sets a desired tension during use that allows free movement of the elongate rod 14 about the cleaning head 36 without excessive strain, while retaining the automatic retraction functions described above.

Figure 8:
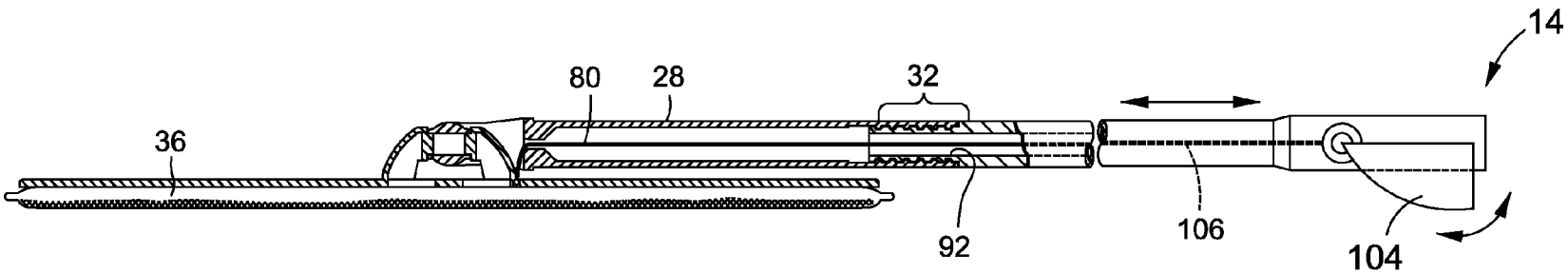
FIG. 8 is a cross sectional view of the cleaning device in which the biasing assembly includes a cocker.

In a second embodiment of the cleaning apparatus 10 shown in FIG. 8, the tension upon the cleaning head 36 is set manually with the biasing assembly 64. More particularly, the biasing assembly 64 is understood to include a cocker 104 that is rotatably mounted to the distal end portion 18 of the elongate rod 14. A rod line 106 extends from the cleaning head 36 through the elongate rod 14, and upon engagement of the cocker 104, the tension in the rod line 106 is increased. As indicated above, the increased tension yields a rotational force being applied to the cleaning head 36 and pulls the same to its maximum pivotal excursion. In this regard, the auto-retraction functionality may be selectively activated for storage, and deactivated during actual use. A variety of cocker mechanisms are contemplated, any such one may be readily substituted without departing from the scope of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

What is claimed is:

1. A cleaning apparatus comprising:

an elongate rod defining a proximal end portion and an opposed distal end portion, the elongate rod including a first linkage member disposed on the proximal end portion;

a cleaning head including a second linkage member pivotally coupled to the first linkage member of the elongate rod, the cleaning head defining a cleaning side and an opposite rod attachment side; and a biasing assembly coupled to the elongate rod and to the cleaning head, the biasing assembly being incorporated into the pivotable coupling of the first linkage member and the second linkage member;

a gimbal defining a first rotation axis and a second rotation axis perpendicular thereto, the first linkage member being mounted to the gimbal about the first rotation axis, and the second linkage member being mounted to the gimbal about the second rotation axis;

wherein the biasing assembly tensions the cleaning head to a maximum pivotal excursion thereof relative to the elongate rod.

2. The cleaning apparatus of claim 1, wherein the gimbal defines a bore extending therethrough and being coaxial with the first rotation axis, and includes a pair of opposed hinge rods coaxial with the second rotation axis and engageable to the second linkage member.

3. The cleaning apparatus of claim 2, further comprising:

a pin defining a slotted first end and a cammed second end, the pin being insertable into the bore of the gimbal and engageable to the first linkage member; and a helical torsion spring in engagement with the slot of the pin.

* * * * *